US009538284B2

(12) United States Patent
Siegumfeldt et al.

(10) Patent No.: US 9,538,284 B2
(45) Date of Patent: *Jan. 3, 2017

(54) AUDIO SYSTEM FOR AUDIO STREAMING AND ASSOCIATED METHOD

(71) Applicant: GN ReSound A/S, Ballerup (DK)

(72) Inventors: Peter Siegumfeldt, Frederiksberg (DK); Ole Gudiksen, Farum (DK)

(73) Assignee: GN RESOUND A/S, Ballerup (DK)

( * ) Notice: Subject to any disclaimer, the term of this patent is extended or adjusted under 35 U.S.C. 154(b) by 208 days.

This patent is subject to a terminal disclaimer.

(21) Appl. No.: 13/849,036

(22) Filed: Mar. 22, 2013

(65) Prior Publication Data

US 2014/0241544 A1 Aug. 28, 2014

(30) Foreign Application Priority Data

Feb. 28, 2013 (DK) ..... 2013 70120
Feb. 28, 2013 (EP) ..... 13157293

(51) Int. Cl.
*H04R 3/00* (2006.01)
*H04R 25/00* (2006.01)

(52) U.S. Cl.
CPC ..... *H04R 3/00* (2013.01); *H04R 25/554* (2013.01); *H04R 2225/55* (2013.01)

(58) Field of Classification Search
CPC ..... H04R 25/00; H04R 25/30; H04R 25/40; H04R 3/00; H04R 3/005; H04R 25/554; H04R 25/558; H04R 2225/00; H04R 2225/021; H04R 2225/023; H04R 2225/025; H04R 2225/51; H04R 2225/55
See application file for complete search history.

(56) References Cited

U.S. PATENT DOCUMENTS 7,995,756 B1 8/2011 McKinney et al.
8,600,530 B2 12/2013 Nagle et al.
(Continued)

FOREIGN PATENT DOCUMENTS

EP 2 015 603 A1 1/2009
JP 2004126577 4/2004
(Continued)

OTHER PUBLICATIONS

"Wi-Fi and Bluetooth—interference issues." HP. Jan. 2002. pp. 1-5.*

(Continued)

*Primary Examiner* — Curtis Kuntz
*Assistant Examiner* — Qin Zhu
(74) *Attorney, Agent, or Firm* — Vista IP Law Group, LLP

(57) ABSTRACT

A method for operating an audio system for transmitting wireless audio streams to a hearing system comprising a hearing device, the audio system comprising a communication unit and a radio system comprising a transmitter unit, the method includes: receiving request data comprising hearing device identification data and a request indicative of an audio track; determining radio system configuration data based on at least a part of the request data; and transmitting an audio stream by the transmitter unit according to the determined radio system configuration data, wherein the audio stream comprises audio stream data and audio identification data for allowing the hearing system to receive the audio stream representative of the requested audio track.

24 Claims, 5 Drawing Sheets

(56) References Cited

U.S. PATENT DOCUMENTS

| | | | | |
|---|---|---|---|---|
| 2002/0124097 | A1 | 9/2002 | Isely et al. | |
| 2003/0055901 | A1 | 3/2003 | Smith, Jr. et al. | |
| 2006/0046651 | A1 | 3/2006 | Hazell et al. | |
| 2006/0274747 | A1 | 12/2006 | Duchscher et al. | |
| 2007/0133832 | A1 | 6/2007 | Digiovanni et al. | |
| 2007/0156268 | A1 | 7/2007 | Galvin et al. | |
| 2007/0162395 | A1 | 7/2007 | Ben-Yaacov et al. | |
| 2008/0080394 | A1 | 4/2008 | Platz et al. | |
| 2008/0175421 | A1 | 7/2008 | Chizari | |
| 2008/0205664 | A1 | 8/2008 | Kim et al. | |
| 2010/0067723 | A1* | 3/2010 | Bergmann et al. | 381/315 |
| 2010/0158292 | A1 | 6/2010 | Pedersen | |
| 2010/0190532 | A1 | 7/2010 | Sampat et al. | |
| 2011/0129106 | A1* | 6/2011 | Hasler et al. | 381/315 |
| 2011/0188662 | A1* | 8/2011 | Jensen et al. | 381/23.1 |
| 2011/0249842 | A1* | 10/2011 | Solum et al. | 381/315 |
| 2011/0319018 | A1* | 12/2011 | Kroman | 455/41.1 |
| 2012/0021707 | A1 | 1/2012 | Forrester | |
| 2012/0189140 | A1 | 7/2012 | Hughes | |
| 2012/0213393 | A1 | 8/2012 | Foo et al. | |
| 2013/0322648 | A1 | 12/2013 | Chukka et al. | |
| 2014/0079241 | A1 | 3/2014 | Chan | |

FOREIGN PATENT DOCUMENTS

| | | | |
|---|---|---|---|
| WO | 2007/139293 | A1 | 12/2007 |
| WO | 2011/027004 | A2 | 3/2011 |
| WO | WO 2013/100933 | A1 | 7/2013 |

OTHER PUBLICATIONS

ListenTech ("Listen") "LT-800 Stationary Transmitter." Oct. 21, 2005. pp. 1-4.*

Phonak, "Theatres and Concert Halls—Solutions for the hearing impaired." pp. 1-12. 2008.*

Phonak, "Phonak ComPilot—User Guide." pp. 1-88. 2012.*

Japanese Office Action dated Sep. 9, 2014, for related JP Patent Application No. 2014-029882, 3 pages.

Japanese Office Action dated Sep. 9, 2014, for related JP Patent Application No. 2014-029867, 3 pages.

Extended European Search Report dated Jun. 21, 2013 for EP Patent Application No. 13157293.5.

Extended European Search Report dated Jun. 11, 2013 for EP Patent Application No. 13157297.6.

Non-final Office Action dated Dec. 12, 2014 for U.S. Appl. No. 13/849,468.

First Technical Examination and Search Report dated Oct. 11, 2013 for DK Patent Application No. PA 2013 70120, 5 pages.

Second Technical Examination—Intention to Grant dated Apr. 29, 2014 for related DK Patent Application No. PA 2013 70119, 2 pages.

Second Technical Examination dated May 1, 2014 for related DK Patent Application No. PA 2013 70120, 2 pages.

Third Technical Examination dated May 26, 2014 for related DK Patent Application No. PA 2013 70120, 2 pages.

First Technical Examination and Search Report dated Oct. 8, 2013 for related DK Patent Application No. PA 2013 70119, 4 pages.

First Examination dated Mar. 27, 2015 for related EP Patent Application No. 13157297.6.

Non-final Office Action dated Nov. 18, 2015 for U.S. Appl. No. 13/849,468.

Final Office Action dated Mar. 16, 2016 for related U.S. Appl. No. 13/849,468.

Advisory Action dated Jun. 13, 2016 for related U.S. Appl. No. 13/849,468.

Notice of Allowance and Fee(s) due dated Jun. 30, 2016 for related U.S. Appl. No. 13/849,468.

Final Office Action dated May 1, 2015 for U.S. Appl. No. 13/849,468.

Advisory Action dated Jul. 15, 2015 for U.S. Appl. No. 13/849,468.

* cited by examiner

AUDIO SYSTEM FOR AUDIO STREAMING AND ASSOCIATED METHOD

RELATED APPLICATION DATA

This application claims priority to and the benefit of Danish Patent Application No. PA 2013 70120, filed on Feb. 28, 2013, and European Patent Application No. 13157293.5, filed on Feb. 28, 2013, pending. The disclosures of both of the above applications are expressly incorporated by reference herein.

FIELD

An embodiment described herein relates to an audio system for audio streaming and associated method. In particular, a method and audio system for transmitting wireless audio streams to hearing system(s) are provided.

BACKGROUND

Wireless communication to and from hearing devices has been increasing in continuation of the developments within wireless communication technology. In a crowded environment where audio is distributed to the crowd, for example in an airport or in a movie theatre, it is known to stream audio via a telecoil solution having a limited bandwidth with limited possibilities of separating different audio streams.

Further, audio streams from neighboring broadcasting areas, such as cinema auditoriums of a cinema complex, may overlap requiring a receiver device to be able to separate and distinguish between audio streams.

SUMMARY

Despite the known solutions there is still a need to personalize and direct different audio streams that are transmitted wirelessly to specific individuals in a crowded environment.

There is also a need for a user of a hearing system to be able to in a simple and effective manner personalize and select desired audio streams.

Accordingly, an audio system for transmitting wireless audio streams to a hearing system is provided. The audio system comprises a radio system comprising at least one stationary transmitter unit including a first transmitter unit for transmitting at least a first audio stream with first audio identification data indicative of the first audio stream; and a communication unit configured to communicate with a hearing system. Further, the audio system is configured to receive request data comprising hearing device identification data and a request indicative of at least one audio track; determine radio system configuration data based on the request data; and transmit at least one audio stream according to the determined radio system configuration data. The audio stream comprises audio stream data and audio identification data for allowing the hearing system to receive the audio stream representative of the requested audio track.

Also disclosed is a method for operating an audio system for transmitting wireless audio streams to a hearing system comprising a hearing device, the method comprising receiving request data, e.g. at the communication unit, the request data comprising hearing device identification data and a request indicative of at least one audio track; determining radio system configuration data based on the request data; and transmitting at least one audio stream according to the determined radio system configuration data, wherein the audio stream or audio streams comprises audio stream data and audio identification data for allowing the hearing system to receive the audio stream representative of the requested audio track.

By the radio system sending audio identification data based on hearing device identification data of the hearing device, the hearing device of the hearing system is able to in a simple way identify a broadcasted audio stream, hereby enabling tailoring of the audio stream to the specific hearing device.

The proposed system and method facilitate several possible uses, such as personalized audible information, which otherwise is difficult in a crowded environment.

It is an advantage that it is possible to stream personalized audible information in a crowded environment, received by the specific user only. Further, the method and audio system enable power saving in hearing devices by reducing the requirements for data sent from the hearing device.

A method for operating an audio system for transmitting wireless audio streams to a hearing system comprising a hearing device, the audio system comprising a communication unit and a radio system comprising a transmitter unit, the method includes: receiving request data comprising hearing device identification data and a request indicative of an audio track; determining radio system configuration data based on at least a part of the request data; and transmitting an audio stream by the transmitter unit according to the determined radio system configuration data, wherein the audio stream comprises audio stream data and audio identification data for allowing the hearing system to receive the audio stream representative of the requested audio track.

Optionally, the request data may comprise an encryption key, the method may further comprise encrypting the audio stream data with the encryption key before transmitting the audio stream.

Optionally, the act of receiving the request data may comprise receiving the request data from a hearing device of the hearing system.

Optionally, the act of receiving the request data may comprise receiving the request data from an accessory device of the hearing system, wherein the accessory device may comprise a mobile phone, a tablet computer, a smart phone, a hearing device remote control unit, or a key card.

Optionally, the act of receiving the request data may comprise receiving the request data at a frequency anywhere from 2.4 GHz to 2.5 GHz, a frequency anywhere from 800 MHz to 1 GHz, and/or a frequency anywhere from 13 MHz to 14 MHz.

Optionally, the act of receiving the request data may comprise receiving the request data from a user interface unit of the audio system.

Optionally, the audio identification data may comprise one or more of a hearing device ID, a transmitter ID, a transmitter group ID, an audio group ID, an audio type ID, and an audio protocol ID.

Optionally, the method may further include determining hearing system configuration data based on the request data; and transmitting the hearing system configuration data to the hearing system for allowing the hearing system to receive the audio stream representative of the requested audio track.

An audio system for transmitting wireless audio streams to a hearing system comprising a hearing device, includes: a radio system comprising a stationary transmitter unit including a first transmitter unit for transmitting at least a first audio stream with first audio identification data indicative of the first audio stream; a communication unit configured to communicate with the hearing system; wherein the audio system is configured to receive request data comprising hearing device identification data and a request indicative of an audio track, determine radio system configuration data based on at least a part of the request data, and transmit an audio stream according to the determined radio system configuration data, wherein the audio stream comprises audio stream data and audio identification data for allowing the hearing system to receive the audio stream representative of the requested audio track.

Optionally, the communication unit may comprise a wireless receiver for receiving the request data.

Optionally, the communication unit may comprise a near field communication device configured to receive hearing device identification data from a near field communication tag of the hearing system.

Optionally, the communication unit may be configured to receive the request data from an accessory device.

Optionally, the radio system may comprise a second transmitter unit for transmitting a second audio stream with second audio identification data indicative of the second audio stream, and a radio system control unit connected to the first and second transmitter units, wherein the radio system control unit is configured to control the first and second transmitter units.

Optionally, the audio system may comprise a user interface unit connected to the communication unit, wherein the user interface is configured to receive the request data indicative of the audio track, and to transmit the request data to the communication unit.

Optionally, the request data may comprise an encryption key, and the radio system may be configured to encrypt the audio stream data with the encryption key before transmitting the audio stream.

Other and further aspects and features will be evident from reading the following detailed description of the embodiments.

BRIEF DESCRIPTION OF THE DRAWINGS

The drawings illustrate the design and utility of embodiments, in which similar elements are referred to by common reference numerals. These drawings are not necessarily drawn to scale. In order to better appreciate how the above-recited and other advantages and objects are obtained, a more particular description of the embodiments will be rendered, which are illustrated in the accompanying drawings. These drawings are not to be considered limiting in the scope of the claims.

DETAILED DESCRIPTION

Figure 1:
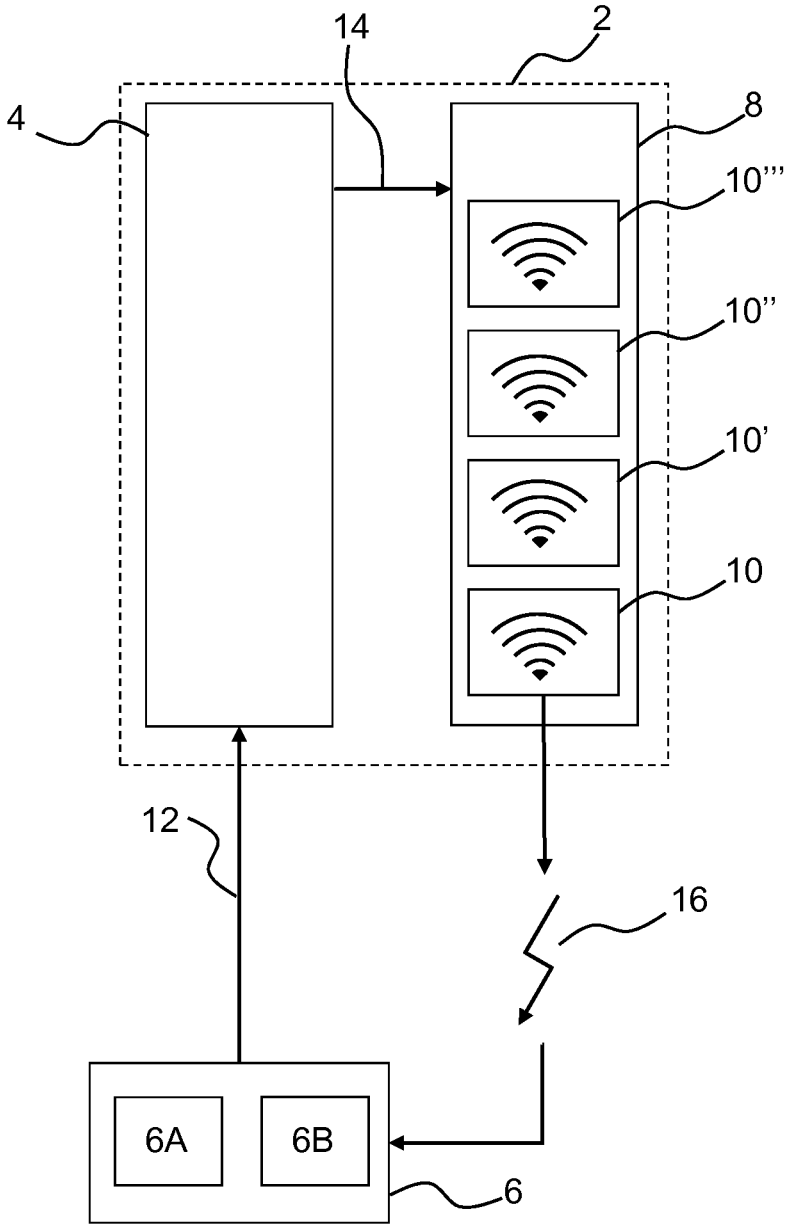
FIG. 1 schematically illustrates an exemplary audio system and a hearing system, FIG. 2 schematically illustrates an exemplary audio system and a hearing system, FIG. 3 schematically illustrates an exemplary audio system and a hearing system, FIG. 4 schematically illustrates an exemplary audio system and a hearing system.

Various embodiments are described hereinafter with reference to the figures. It should be noted that the figures are not drawn to scale and that elements of similar structures or functions are represented by like reference numerals throughout the figures. It should also be noted that the figures are only intended to facilitate the description of the embodiments. They are not intended as an exhaustive description of the claimed invention or as a limitation on the scope of the claimed invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated.

The embodiments described herein relate to an audio system capable of streaming audio stream(s) representing audio track(s) to a hearing device. A hearing device of the hearing system may comprise a processor configured to compensate for hearing loss or disability of the hearing device user. A hearing device may be identified by hearing device identification data (hearing device ID). With the use of the hearing device identification data, the audio system is capable of streaming an audible signal to a specific hearing device having specific hearing device identification data or a group of hearing devices sharing specific hearing device identification data.

Upon receipt of request data, radio system configuration data is determined based on the request data and in particular based on hearing device identification data of the request data. Subsequently, at least one audio stream is transmitted from at least one transmitter unit according to the radio system configuration data. The at least one audio stream comprises audio identification data according to and/or including hearing device identification data comprised in the request data. The hearing system is thus able to search for and receive only the desired audio stream, representative of the audio track requested. This may lead to improved power management of the transceiver or receiver of the hearing device, thus providing reduced power consumption.

The hearing system comprises a hearing device and optionally an accessory device. Thus, transmitting request data from the hearing system may comprise transmitting request data from a hearing device and/or an accessory device of the hearing system. Transmitting request data from the hearing system may comprise transmitting request data or parts thereof as an email or a text message, e.g. an SMS.

An audio track in the present context is an audible signal, such as an airport call, a movie sound track, speech or a piece of music.

An audio stream is an electromagnetic signal representative of an audio track. A transmitter sends an audio stream. An audio stream comprises audio stream data and audio identification data, the audio stream data being representative of an audio track. Audio identification data (audio ID) is data enabling identification of or used for identification of a specific audio stream.

Audio identification data (Audio ID) may comprise hearing device identification data (hearing device ID) allowing the hearing device associated with the particular hearing device ID to identify the stream to receive. Audio identification data may further or alternatively comprise one or more of transmitter ID, transmitter group ID, audio group ID, audio type ID, and audio protocol ID.

Transmitter identification data (transmitter ID) is data enabling identification of or used for identification of a specific transmitter of the radio system.

Transmitter group identification data (transmitter group ID) is data enabling identification of or used for identification of a group of transmitters of the radio system. A group of transmitters comprises a plurality of transmitters. Transmitters may be grouped based on audio track, position within a selected area, etc. A first group of transmitters may be formed by transmitters streaming a first audio track but with different audio ID. A second group of transmitters may be formed by transmitters streaming a second audio track but with different audio ID.

Audio group identification data (audio group ID) is data enabling identification of or used for identification of a group of audio streams relevant for the user of the hearing system. Audio group ID may comprise data indicative of audio track or parts of an audio track. Audio group ID may comprise data indicative of language.

Audio type identification data (audio type ID) is data enabling identification of or used for identification of audio type. Audio type ID may be representative of hearing device models/manufacturers able to listen to the audio stream in question.

Audio protocol identification data (audio protocol ID) is data enabling identification of or used for identification of audio protocol, such as encoding format, frequencies or other physical properties of the audio stream.

A transmitter unit may comprise one or more antennas. A transmitter unit may be configured to stream a plurality of audio streams simultaneously. This may be achieved e.g. by a transmitter unit comprising a plurality of antennas.

The radio system may store several audio tracks which can be streamed on request. The hearing system is thus able to, upon request, to receive desired audio stream data containing the requested audio track.

Receiving the request data may comprise receiving request data at the communication unit. Request data may comprise hearing device ID and a request indicative of at least one audio track.

The request data, e.g. received at the communication unit, may comprise an encryption key, and the method may comprise encrypting the audio stream data with the encryption key before transmitting the at least one audio stream. The encryption key may e.g. be transmitted from the hearing system. The radio system may be configured to encrypt the audio stream data with the encryption key before transmitting the at least one audio stream. Encrypting the audio stream using an encryption key provided by the hearing system allows the hearing system to receive and decrypt the encrypted audio stream using a decryption key maintained by the hearing system. Thereby other hearing devices are prevented from intercepting the audio track represented by the audio stream data, even if the hearing device ID was intercepted during transmission to the audio system. Thus, secure and personal streaming of wireless audio streams are provided for.

The request data may comprise hearing system identification data. The hearing system data may contain information about the hearing system such as model of the hearing device, number of hearing devices in the hearing system, type of hearing device, and if there is an accessory device, type of accessory device, phone number and/or email address. Providing hearing system identification data at the audio system enable the audio system to setup one or more transmitter units specific to the hearing system from which the request was received, thus allowing personalized and secure audio streaming. Providing hearing system identification data may enable the audio system with the possibility to transmit hearing system configuration data to the hearing system, specific to the hearing system from which the request data was received.

The request indicative of an audio track, e.g. received at the communication unit, may be received from different sources or utilizing different methods depending on the audio system in question. The communication unit of the audio system may comprise a wireless receiver for receiving the request data or at least part of the request data. Transmittal of hearing device ID to the audio system is thus made easy. Likewise, the request indicative of an audio track of interest may easily be transferred to the audio system.

The hearing system comprises at least one hearing device. Thus, receiving request data may comprise receiving request data from a hearing device of the hearing system.

The hearing system may in addition to a first hearing device and optionally a second hearing device comprise an accessory device. Thus, receiving request data may comprise receiving request data from an accessory device of the hearing system. The accessory device may be such as a mobile phone, a tablet computer, a smart phone, a hearing device remote control unit, or a key card.

Receiving of the request data may comprise receiving part of the request data from a hearing device of the hearing system, part of the request data from an accessory device and/or part of the request data from a unit not part of the hearing system, e.g. a user interface of the audio system.

The communication unit may comprise a near field communication device configured to receive hearing device ID from a near field communication tag of the hearing system.

When the hearing system or a part thereof carrying a near field communication tag is in close proximity of the near field communication device of the communication unit, e.g. within 40 cm or within 20 cm or within 15 cm or within 5 cm, a near field communication tag of the hearing system transmits the hearing device ID to the near field communication device of the communication unit. The near field communication device of the audio system may be configured to receive hearing device ID at a frequency in the range from 13 MHz to 14 MHz.

Likewise, the request indicative of the audio track of interest may be transferred from the hearing system to the communication unit using the near field communication device, when a near field communication tag of the hearing system is in close proximity of the near field communication device of the communication unit, e.g. within 40 cm or within 20 cm or within 15 cm or within 5 cm.

Using a near field communication device allows for a simple and user friendly transfer of information from the hearing system to the audio system, without interference from other devices in the area. Alternatively other technologies may be used for receiving request data, such as a phone line, Bluetooth or WiFi.

Alternatively or in addition to the above, the communication unit may be configured to receive request data, or part of the request data, from an accessory device. Communication between the accessory device and the communication unit of the audio system may be e.g. via the internet, a phone line, a local area network, Bluetooth or a near field communication device.

The communication unit may comprise a web server configured to receive the request data, or part of the request data, from an accessory device of the hearing system.

Receiving request data may comprise receiving a text message such as an SMS and/or an email. Thus, the communication unit may comprise a unit allowing receiving request data by receiving a text message, such as an SMS or email. The text message may be sent from the accessory device of the hearing system.

Receiving request data may comprise receiving request data at a frequency in the range from 2.4 GHz to 2.5 GHz and/or in the range from 800 MHz to 1 GHz and/or in the range from 13 MHz to 14 MHz, and/or in the range from 3.6 GHz to 3.7 GHz and/or in the range from 4.9 GHz to 5.9 GHz.

The audio system may comprise a user interface unit that may be connected to the communication unit. The user interface may be configured to receive the request data, and the user interface may be configured to transmit the request data to the communication unit. Thus, receiving request data may comprise receiving request data from a user interface unit of the audio system. The user interface unit may receive the request from a user of the audio system. The user interface unit may comprise one or more of a touchscreen, a keyboard, a mouse. The user interface unit may comprise a monitor or other display, including LED display, plasma screen, OLED display.

The user interface unit may be designed such that the user or a person serving the user of the hearing system may type, or in another way indicate, what audio track he request to be streamed to his hearing system. Similarly the user may input the hearing device ID to the user interface unit. The user interface unit transmits the request data to the communication unit and the radio system is configured accordingly. Thus, the audio system is able to stream the audio stream representative of the requested audio track to the hearing device of the hearing system.

In another exemplary audio system, the user interface unit may physically be placed in connection with a near field communication device of the communication unit. The user may input his request of an audio track using the user interface unit while transferring hearing device ID via the near field communication device of the communication unit.

The radio system may comprise a second transmitter unit for transmitting at least a second audio stream with second audio ID indicative of the second audio stream.

To control the transmittal of audio streams from the transmitter units, the radio system may comprise a radio system control unit connected to the transmitter units and configured to control the transmitter units. The radio system control unit may be connected to the communication unit to enable communication of information regarding the audio streams between the radio system and the communication unit.

The radio system control unit may determine configuration of each of the transmitter units, and decide which audio stream data to stream from which unit. Further the radio system control unit may control the audio ID to be transmitted as part of the audio stream, e.g. by sending a control signal to the respective transmitters.

The audio system may comprise a database unit configured for storing or comprising audio track, audio stream data and/or audio ID. The database unit may comprise radio system configuration data for the radio system, e.g. in the form of a lookup table.

The database unit may be connected to the radio system and/or the communication unit. Upon receiving request data, e.g. at the communication unit, determining radio system configuration data may comprise searching the database unit for radio system configuration data corresponding to the requested audio track. The determined radio system configuration data may be transmitted to the database unit. Thus, the radio system may retrieve data, from the database unit, indicative of contents to be transmitted at the transmitter units.

The database unit may be connected to the radio system via a radio system control unit. The radio system may transmit data to the database unit containing information of the current state of each transmitter unit. Information transmitted from the radio system to the database unit may for example contain information on audio streams being currently transmitted and corresponding audio ID, audio group ID, transmitter ID and/or transmitter group ID, etc.

The database unit may also be connected to the user interface unit. The user interface unit may transmit data to the database unit, indicative of controlling the transmitter units of the radio system. The user interface may provide information to the database such as requested audio tracks and hearing device ID.

The radio system configuration data for the radio system may comprise first configuration data for a first hearing system model or type and second configuration data for a second hearing system model or type. The hearing system may provide information of the type and/or model of the hearing device to the audio system. Hearing system information, type and/or model may be transferred with the request data. Hence the request data may comprise hearing system data. According to the information provided, the radio system may choose from several configurations in order to stream the audio stream in a manner which the hearing device is able to receive.

Each audio stream comprises audio ID, the audio ID may comprise one or more of hearing device ID, transmitter ID, transmitter group ID, audio group ID, audio type ID, audio protocol ID. Adding additional information to the audio ID, besides containing the hearing device ID, may provide such as increased possibility for error detection, a more versatile system or increased possibilities for quality of reception.

The method may comprise transmitting the request data via a near field communication device in the communication unit and a near field communication device in the hearing system.

In an exemplary method, transmitting the hearing device ID may be achieved by having the hearing system in close proximity to a near field communication device of the communication unit. A choice of a plurality of near field communication devices of the communication unit may serve as a way of selecting the audio track to request. Hereby, a power consuming pairing procedure between the hearing device and the audio system is avoided or at least simplified.

In another exemplary method, the way of selecting the audio track to request is performed using a user interface of the audio system.

The communication unit of the audio system may comprise a transmitter for transmitting data to a hearing system. The transmitter of the communication unit may comprise any type of transmitter such as a wireless transmitter or near field communication device.

The method may comprise determining hearing system configuration data based on the request data; and transmitting the hearing system configuration data to the hearing system for allowing the hearing system to receive the audio stream representative of the requested audio track. In an exemplary method, the audio system may receive request data from a hearing system, the request data comprising a request for hearing system configuration data and a request indicative of an audio track. Thus, the audio system may provide hearing system configuration data for the hearing system in order for the hearing system to be configured according to the transmittal of the audio stream representative of the requested audio track.

The audio stream(s) may be transmitted at selected frequencies e.g. at a frequency in the range from 2.4 GHz to 2.5 GHz or at a frequency in the range from 800 MHz to 1 GHz. Other suitable frequencies may be in the range from 3.6 GHz to 3.7 GHz and/or in the range from 4.9 GHz to 5.9 GHz.

FIG. 1 schematically illustrates an exemplary audio system 2 for transmitting wireless audio streams to a hearing system 6. The hearing system 6 comprises a hearing device 6A and optionally an accessory device 6B. The audio system 2 comprises a radio system 8 comprising a plurality of transmitter units 10, 10', 10", 10'". Each transmitter unit 10, 10', 10", 10'" is configured to transmit an audio stream with respective audio ID indicative of the audio stream. The audio system 2 further comprises a communication unit 4 configured to communicate with the hearing system 6. The audio system 2 is configured to receive request data 12 comprising hearing device ID and a request indicative of at least one audio track. The audio system 2 is further configured to determine radio system configuration data for the radio system 8 based on the request data and to transmit at least one audio stream 16 according to the determined radio system configuration data, wherein the audio stream 16 comprises audio stream data and audio ID for allowing the hearing system 6 to receive the audio stream 16 representative of the requested audio track.

In an exemplary method, the hearing system 6 transmits request data 12 to the communication unit 4. The communication unit 4 determines radio system configuration data for the radio system 8 based on the received request data 12 and transmits the determined radio system configuration data 14 to the radio system 8. The configuration data 14 received at the radio system 8 is indicative of the hearing device ID and requested audio ID received from the hearing system 6. In the illustrated audio system, the transmitter unit 10 transmits an audio stream 16 according to the radio system configuration data 14 received from the communication unit 8. The audio stream 16 comprises audio stream data and audio ID at least comprising hearing device ID. The hearing device 6A of the hearing system 6 is able to identify and receive the requested audio stream 16 by the audio ID comprising the hearing device ID. The audio ID, may optionally further comprise several other useful information, such as transmitter ID, transmitter group ID, audio group ID, audio type ID, and audio protocol ID.

The request data 12 may be transmitted via a network (not shown), e.g. the internet, or a local area network. The request data 12 may be transmitted wirelessly.

The second, third and fourth transmitter units 10', 10", 10'" may in an exemplary audio system stream audio stream data identical to the audio stream data of the first audio stream 16 transmitted from the first transmitter 10. The audio ID of the second to fourth audio streams may further comprise the same hearing device ID as the first audio stream 16, thus enabling the hearing system to receive the requested audio track from either of the transmitter units.

The second, third and fourth transmitter units 10', 10", 10'", may in an exemplary audio system transmit second, third and fourth audio streams (not shown) that may be directed to other hearing systems (not shown), thus comprising audio ID indicative of hearing device ID of the other hearing systems.

The hearing system 6 may comprise at least one hearing device 6A and optionally an accessory device 6B such as a mobile phone, a tablet computer, a smart phone, a hearing device remote control unit or a key card. The accessory device 6B and the hearing device 6A may transmit data between each other. Transmission of data between the accessory device 6B and the hearing device 6A may be performed wirelessly, using e.g. bluetooth or similar, WiFi or near field communication.

The audio system 2 may optionally comprise one or more of a near field communication device, a user interface unit, a radio system control unit and/or a database unit. Audio systems comprising these units are exemplified in the exemplary audio systems illustrated in FIGS. 2-4.

Figure 2:
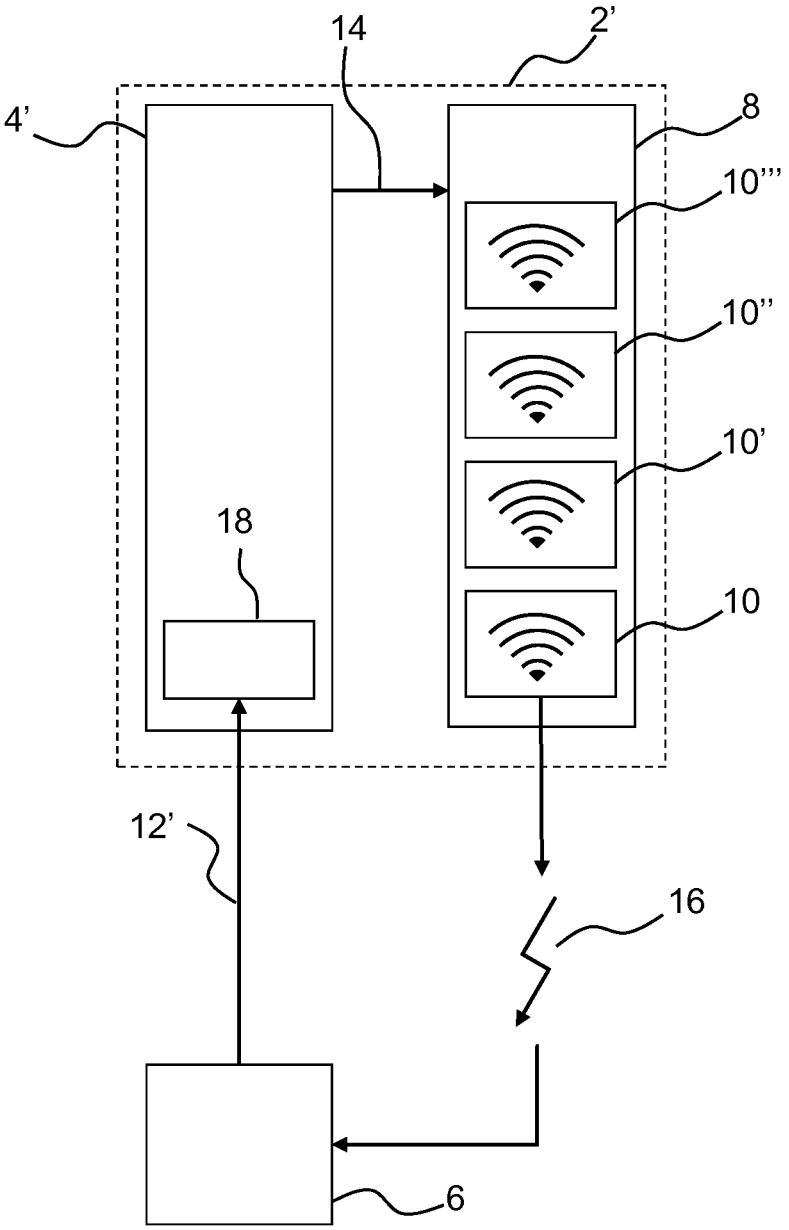

FIG. 2 schematically illustrates an exemplary audio system. The audio system 2' comprises the same features as the audio system 2 shown in FIG. 1. The communication unit 4' comprises a near field communication device 18 for receiving and/or transmitting short range data to and/or from the hearing system 6. The communication unit 4' receives request data 12 comprising hearing device ID and a request indicative of at least one audio track from the hearing system 6 via the near field communication device 18.

In an exemplary audio system, a part of the request data 12, e.g. the hearing device ID, may be received at the communication unit 4' via the near field communication device 18 while another part of the request data 12 e.g. the request indicative of at least one audio track, may be received at the communication unit 4' by an alternative method e.g. via the internet a local area network or a phone line.

It is to be understood that the near field communication device 18 is an example of a receiver. Other exemplary receivers may include a receiver configured for frequencies between 2.4 and 2.5 GHz. In exemplary communication units, the request data are received via the internet, i.e. the communication unit may comprise a web interface (not shown).

Figure 3:
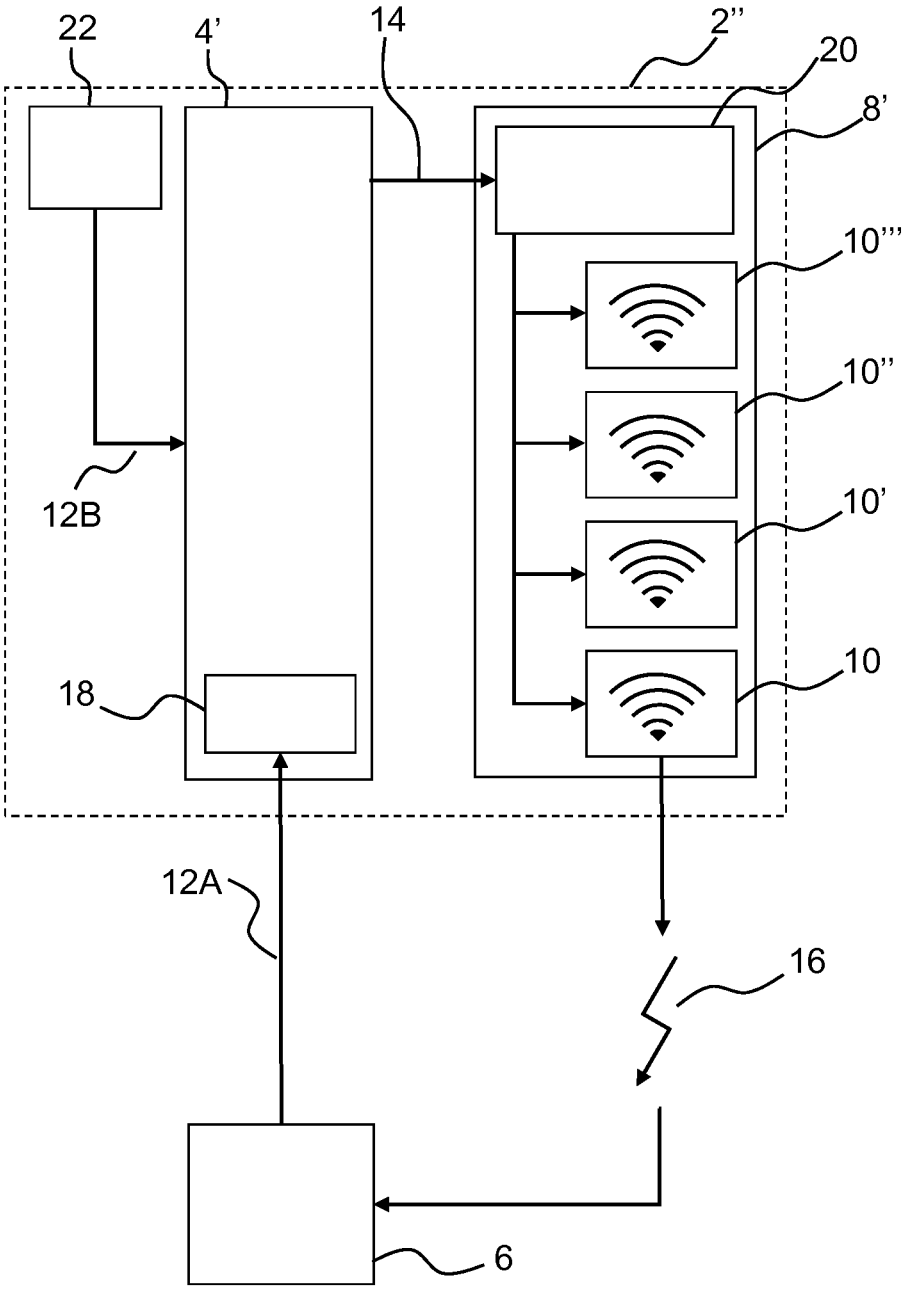

FIG. 3 schematically illustrates an exemplary audio system. The audio system 2" comprises the same features as the audio system 2' shown in FIG. 2. The audio system 2" comprises an optional user interface unit 22, and the radio system 8' of audio system 2" further comprises an optional radio system control unit 20.

The radio system control unit 20 is configured to control the transmitter units 10, 10', 10", 10'", according to the radio system configuration data 14 received from the communication unit 4', e.g. controlling for each transmitter unit 10, 10', 10", 10'" which audio track to stream and what audio ID to transmit along with the audio stream data. The transmitter units 10, 10', 10", 10'" of the radio system 8' each transmits an audio stream with audio ID controlled by the radio system control unit 20.

The user interface unit 22 is configured to receive a request indicative of at least one audio track 12B and transmit the received request to the communication unit 4'. The hearing system 6 provides the hearing device identification 12A data, e.g. via the near field communication device 18 or other receiver.

In a practical exemplary audio system, the user interface unit 22 may physically be placed in connection with the near field communication device 18. The user may input his request of an audio track 12B using the user interface unit 22 while transferring hearing device ID 12A via the near field communication device 18. The audio system 2" may be configured to pair the received request 12B with the hearing device ID 12A being received via the near field communication device 18 at the same time. Alternatively the user may be prompted by the user interface unit 22 when to place the hearing device in the vicinity of the near field communication device 18. In another exemplary audio system, the user may manually type the hearing ID at the user interface unit.

Figure 4:
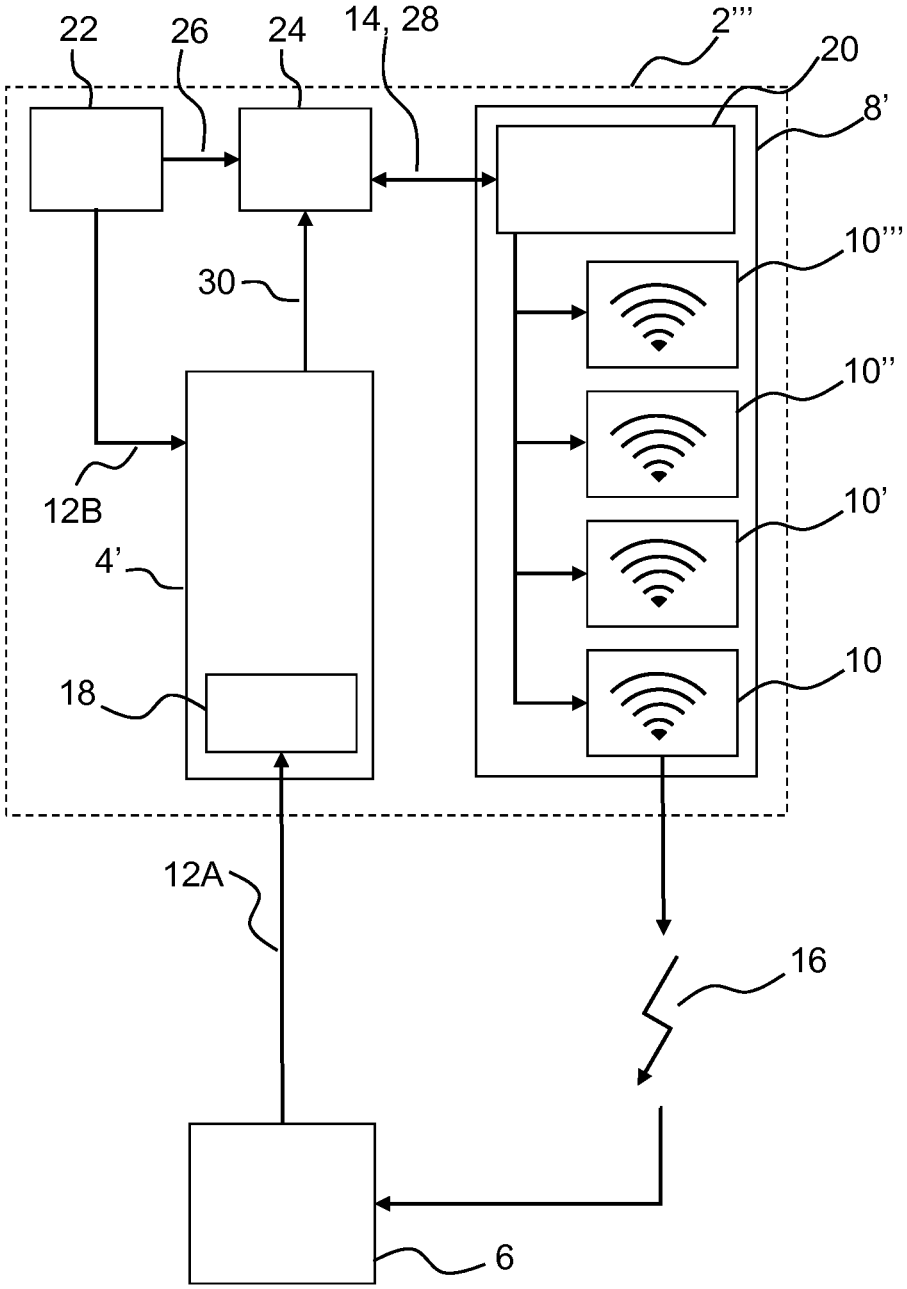

FIG. 4 schematically illustrates an exemplary audio system. The audio system 2'" comprises the same features as the audio system 2" shown in FIG. 3. The audio system 2'" comprises an optional database unit 24. The communication unit 4' transmits data indicative of requested data 30 to the database unit 24. The radio system control unit 20 receives radio system configuration data 14 from the database unit 24. The radio system control unit 20 is controlling the plurality of transmitter units 10, 10', 10", 10''', according to the radio system configuration data 14 obtained from the database unit 24.

The radio system control unit 20 may request 28 radio system configuration data from the database and receive radio system configuration data 14 from the database unit 24 on a regular basis, e.g. once every other second, once every second, twice per second or any other regular time interval. The radio system may be configured to detect changes to the database 24 and request radio system configuration data 28 from the database upon detection of changes to the database 24, and receive radio system configuration data 14 as response to such a request.

The user interface unit 22 may be able to transmit radio system configuration data 26 directly to the database unit 24. This may be the case e.g. if available audio tracks are to be updated and/or due to database maintenance. The user interface unit 22 may in an exemplary audio system transmit request data to the database.

Figure 5:
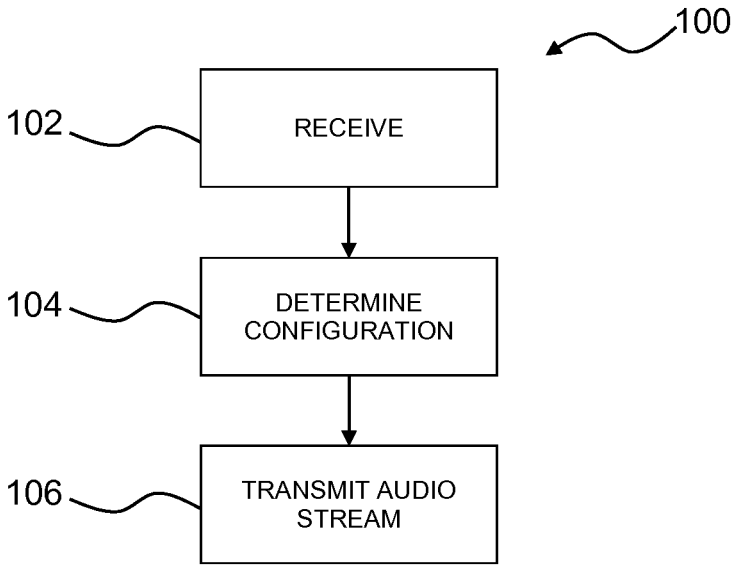
FIG. 5 is a flow diagram of an exemplary method according to some embodiments.

FIG. 5 shows a flow diagram of an exemplary method 100 for operating an audio system for transmitting wireless audio streams to at least one hearing system, the audio system comprising a communication unit and a radio system. The radio system comprises at least one stationary transmitter unit including a first transmitter unit for transmitting at least a first audio stream with first audio ID indicative of the first audio stream.

The method 100 comprises receiving 102 request data comprising hearing device ID and a request indicative of at least one audio track; determining 104 radio system configuration data for the radio system based on the request data received; and transmitting 106 at least one audio stream according to the determined radio system configuration data. The audio stream comprises audio stream data and audio ID for allowing the hearing system to receive the audio stream representative of the requested audio track. The audio ID comprises hearing device ID. The audio stream is thereby receivable by the hearing device with the hearing device ID.

The request data may comprise data enabling the audio system to identify at least one audio stream representative of the audio track indicated in the request. The request may comprise or indicate e.g. an audio track for a specific movie starting at a specific time or all calls in an airport regarding a certain flight or passenger, e.g. the user of the hearing system. The request may comprise hearing system data, e.g. model of the hearing device, type of hearing device, and if there is an accessory device, type of accessory device, phone number and/or email. The request data may be transmitted by sending a text message such as an SMS or an email or it may be transmitted via the internet, a local area network, a Bluetooth transceiver and/or a near field communication device.

Receiving 102 the request data from the hearing system may comprise receiving data from a hearing device of the hearing system or from an accessory device of the hearing system. Receiving 102 the request data may comprise receiving a text message such as an SMS or an email or the request data may be transmitted via the internet, a local area network, a Bluetooth transceiver and/or a near field communication device.

Determining 104 radio system configuration data may comprise retrieving information about audio streams from a database unit of the audio system. The radio system configuration data is based on the received request data and corresponding information of audio streams. The determination 104 of radio system configuration data may comprise utilizing hearing system data received as part of the request data 102, allowing the transmitter unit to be configured specifically to the hearing device and/or hearing system in question.

Transmitting at least one audio stream 106 may comprise adding the hearing device ID of the request data to an existing audio stream transmitted from a transmitter unit of the radio system. Transmitting at least one audio stream 106 may comprise initiating streaming of a new audio stream, upon receiving request data.

Although particular embodiments have been shown and described, it will be understood that they are not intended to limit the claimed inventions, and it will be obvious to those skilled in the art that various changes and modifications may be made. The specification and drawings are, accordingly, to be regarded in an illustrative rather than restrictive sense. The claimed inventions are intended to cover alternatives, modifications, and equivalents.

LIST OF REFERENCES

2, 2', 2", 2''' audio system
4, 4' communication unit
6 hearing system
8, 8' radio system
10 first transmitter unit
10' second transmitter unit
10" third transmitter unit
10''' fourth transmitter unit
12 request data comprising hearing device ID and a request indicative of an audio stream
12A transmitting hearing device ID
12B request indicative of an audio stream
14 radio system configuration data
16 first audio stream
18 near field communication unit
20 radio system control unit
22 user interface unit
24 database unit
26 user interface unit data for the database unit
28 radio system data for the database unit
30 communication unit data for the database unit
100 method for operating an audio system
102 receiving request data
104 determining radio system configuration data
106 transmitting audio stream

The invention claimed is:

1. A method for operating an audio system for transmitting a wireless audio stream to a hearing system comprising a hearing device, the hearing device comprising a processor configured to compensate for hearing loss or disability of a user of the hearing device, the audio system comprising a communication unit and a radio system comprising a transmitter unit, wherein the transmitter unit is stationary within a building, the method comprising:

receiving request data comprising hearing device identification data and a request indicative of an audio track, wherein the act of receiving the request data is performed by the audio system having the transmitter unit that is stationary within the building;

determining radio system configuration data based on at least a part of the request data; and transmitting an audio stream by the transmitter unit that is stationary within the building according to the determined radio system configuration data, wherein the audio stream comprises audio stream data and the hearing device identification data for allowing the hearing system to determine whether the hearing system is an intended recipient of the audio stream data.

2. The method according to claim 1, wherein the request data comprises an encryption key, the method further comprising encrypting the audio stream data with the encryption key before transmitting the audio stream.

3. The method according to claim 1, wherein the act of receiving the request data comprises receiving the request data from the hearing device of the hearing system.

4. The method according to claim 1, wherein the act of receiving the request data comprises receiving the request data from an accessory device of the hearing system, wherein the accessory device comprises a mobile phone, a tablet computer, a smart phone, a hearing device remote control unit, or a key card.

5. The method according to claim 1, wherein the act of receiving the request data comprises receiving the request data at a frequency anywhere from 2.4 GHz to 2.5 GHz, a frequency anywhere from 800 MHz to 1 GHz, and/or a frequency anywhere from 13 MHz to 14 MHz.

6. The method according to claim 1, wherein the act of receiving the request data comprises receiving the request data from a user interface unit of the audio system.

7. The method according to claim 1, wherein the hearing device identification data comprises one or more of a hearing device ID, a transmitter ID, a transmitter group ID, an audio group ID, an audio type ID, and an audio protocol ID.

8. The method according to claim 1, further comprising:

determining hearing system configuration data based on the request data; and transmitting the hearing system configuration data to the hearing system for allowing the hearing system to receive the audio stream representative of the requested audio track.

9. An audio system for transmitting a wireless audio stream to a hearing system comprising a hearing device, the hearing device comprising a processor configured to compensate for hearing loss or disability of a user of the hearing device, the audio system comprising:

a radio system comprising a stationary transmitter unit including a first transmitter unit for transmitting at least a first audio stream with first audio identification data indicative of the first audio stream, wherein the first transmitter is stationary in a building;

a communication unit configured to communicate with the hearing system;

wherein the audio system is configured to receive request data comprising hearing device identification data and a request indicative of an audio track, and determine radio system configuration data based on at least a part of the request data, and wherein the first transmitter that is stationary in the building is configured to transmit an audio stream according to the determined radio system configuration data, wherein the audio stream comprises audio stream data and the hearing device identification data for allowing the hearing system to determine whether the hearing system is an intended recipient of the audio stream data.

10. The audio system according to claim 9, wherein the communication unit comprises a wireless receiver for receiving the request data.

11. The audio system according to claim 9, wherein the communication unit comprises a near field communication device configured to receive the hearing device identification data from a near field communication tag of the hearing system.

12. The audio system according to claim 9, wherein the communication unit is configured to receive the request data from an accessory device.

13. The audio system according to claim 9, wherein the radio system comprises a second transmitter unit for transmitting a second audio stream with second audio identification data indicative of the second audio stream, and a radio system control unit connected to the first and second transmitter units, wherein the radio system control unit is configured to control the first and second transmitter units.

14. The audio system according to claim 9, wherein the audio system comprises a user interface unit connected to the communication unit, wherein the user interface is configured to receive the request data indicative of the audio track, and to transmit the request data to the communication unit.

15. The audio system according to claim 9, wherein the request data comprises an encryption key, and the radio system is configured to encrypt the audio stream data with the encryption key before transmitting the audio stream.

16. The audio system according to claim 12, wherein the accessory device comprises a mobile phone, a tablet computer, a smart phone, a hearing device remote control unit, or a key card.

17. The audio system according to claim 9, wherein the hearing device identification data comprises hearing aid identification data.

18. The method according to claim 1, wherein the hearing device identification data includes hearing aid identification data.

19. The audio system according to claim 9, wherein the hearing device identification data comprises an identifier of an accessory device.

20. The audio system according to claim 9, wherein the radio system is configured to add the hearing device identification data to the audio stream data to form the audio stream before the audio stream is transmitted from the radio system.

21. The method according to claim 1, wherein the hearing device identification data comprises an identifier of an accessory device.

22. The method according to claim 1, further comprising adding the hearing device identification data to the audio stream data to form the audio stream before the audio stream is transmitted.

23. The method according to claim 1, further comprising rejecting the audio stream data by the hearing system when the hearing device identification data does not match an identifier associated with the hearing system.

24. The method according to claim 1, further comprising accepting the audio stream data by the hearing system for presentation to a user when the hearing device identification data matches an identifier associated with the hearing system.

* * * * *